US006456008B1

(12) United States Patent
Fukuyo et al.

(10) Patent No.: US 6,456,008 B1
(45) Date of Patent: Sep. 24, 2002

(54) METAL HALIDE LAMP HAVING IMPROVED SHUNTING CHARACTERISTICS

(75) Inventors: Takeshi Fukuyo; Shinichi Irisawa; Yoshitaka Ohshima, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 35 days.

(21) Appl. No.: 09/593,152

(22) Filed: Jun. 14, 2000

(30) Foreign Application Priority Data

Jun. 14, 1999 (JP) ..... 11-166692

(51) Int. Cl.[7] ..... H01J 17/20; H01J 61/18

(52) U.S. Cl. ..... 313/638; 313/620; 313/639; 313/643

(58) Field of Search ..... 313/620, 623, 313/636, 377, 638, 639, 640, 641, 642, 643

(56) References Cited

U.S. PATENT DOCUMENTS

| | | | | |
|---|---|---|---|---|
| 4,387,319 A | | 6/1983 | White et al. | 313/620 |
| 4,634,927 A | | 1/1987 | Mori et al. | 313/486 |
| 4,935,668 A | * | 6/1990 | Hansler et al. | 315/82 |
| 5,021,703 A | * | 6/1991 | Passmore et al. | 313/25 |
| 5,144,201 A | * | 9/1992 | Graham et al. | 313/634 |
| 5,159,229 A | * | 10/1992 | Passmore et al. | 313/25 |
| 5,196,759 A | * | 3/1993 | Parham et al. | 313/112 |
| 5,225,733 A | * | 7/1993 | Krasko | 313/25 |
| 5,225,738 A | * | 7/1993 | Ramaiah et al. | 313/641 |
| 5,327,042 A | * | 7/1994 | Bazin et al. | 313/25 |
| 5,363,007 A | * | 11/1994 | Fromm et al. | 313/25 |
| 5,424,609 A | * | 6/1995 | Geven et al. | 313/623 |
| 5,461,281 A | * | 10/1995 | Fromm et al. | 313/556 |
| 5,471,110 A | * | 11/1995 | van der Leeuw et al. | 313/25 |
| 5,694,002 A | * | 12/1997 | Krasko et al. | 313/641 |
| 5,708,328 A | * | 1/1998 | Mathews et al. | 313/573 |
| 5,773,932 A | * | 6/1998 | Ooyama et al. | 313/639 |
| 5,877,591 A | | 3/1999 | Nagata et al. | 313/634 |
| 5,942,850 A | * | 8/1999 | Rutan et al. | 313/571 |
| 6,072,268 A | * | 6/2000 | Dolan et al. | 313/112 |
| 6,271,628 B1 | * | 8/2001 | Sugitani et al. | 313/637 |
| 6,285,130 B1 | * | 9/2001 | Nakagawa et al. | 313/620 |

FOREIGN PATENT DOCUMENTS

| | | | |
|---|---|---|---|
| GB | 2 216 334 | 10/1989 | H01J/61/12 |
| GB | 2 265 251 A | 9/1993 | H01J/61/12 |
| JP | 61-68849 | 4/1986 | H01J/61/20 |
| JP | 2-295059 | 12/1990 | H01J/61/88 |

* cited by examiner

*Primary Examiner*—Vip Patel
*Assistant Examiner*—Kevin Quarterman
(74) *Attorney, Agent, or Firm*—Sughrue Mion, PLLC

(57) ABSTRACT

The amount of a metal halide to be enclosed in a generally ellipsoidal discharge space 24 within a discharge vessel 20*a* is set in the range 0.006–0.01 mg per unit volume (μl) of the discharge space 24. If the amount is less than 0.01 mg/μl, the deposit of metal halide 32 on the inner surface of the discharge space 20*a* in its lowest position midway between the narrow end portions thereof will not cause "shunting" of the arc between the electrodes 26A, 26B. As a result, the arc is effectively prevented from fizzling out after the metal halide lamp is switched on. To ensure that the metal halide lamp produces the intended luminous flux and color of light, the amount of the metal halide to be enclosed in the discharge space 24 should not be lower than 0.006 mg/μl.

10 Claims, 5 Drawing Sheets

METAL HALIDE LAMP HAVING IMPROVED SHUNTING CHARACTERISTICS

BACKGROUND OF THE INVENTION

1. Technical Field of Invention

The present invention relates to a metal halide lamp suitable for typical use as a light source in vehicular headlights.

2. Prior Art

Because of their ability to provide illumination at high luminance, metal halide lamps are increasingly used today as a light source in vehicular headlights and other applications.

The construction of a conventional metal halide lamp for typical use in vehicular headlights is shown in FIG. 5. It comprises a discharge vessel 104 forming a generally ellipsoidal discharge space 102 extending in a longitudinal direction and a pair of electrodes 106A, 106B embedded in the discharge vessel 104 at the narrowest end portions of the discharge space 102. The tips of electrodes 106A, 106B project into the discharge space 102. Mercury, a starter gas and a metal halide are enclosed in the discharge space 102.

The metal halide is enclosed in order to enhance the lamp efficiency and color rendering. The amount of the metal halide being enclosed is set to provide a predetermined luminous flux and light color, while ensuring that no excess amount will affect the luminous intensity distribution pattern. Specifically, if the discharge space 102 has a capacity of about 30 $\mu$l, the amount of the metal halide enclosed should range from about 0.45 to 0.6 mg (from about 0.015 to about 0.02 mg/$\mu$l when calculated for the amount enclosed per unit volume).

A problem with the conventional metal halide lamp described above is that an arc often fizzles out after the lamp was switched on.

When the lamp is not on, a metal halide 108, as shown in FIG. 5, is deposited in the lowest area of the inner surface of the discharge vessel 104, which is midway between the narrow end portions of the discharge vessel 104. The metal halide 108 evaporates when the lamp is turned on. If the amount of metal halide 108 enclosed in the discharge space 102 is excessive compared to the volume of the discharge space 102, the metal halide deposit 108 in the lowest area of the inner surface of the discharge vessel 104 is very close to the electrodes 106A, 106B. Even if a high voltage is applied between these electrodes, a portion of the arc developed between the electrodes 106A, 106B is prone to move toward the metal halide 108, rather than growing until it bridges the two electrodes 106A, 106B. If this "shunting" occurs, the effective impedance between the electrodes 106A, 106B decreases to such an extent that the arc does not grow but fizzles out.

Thus, the conventional metal halide lamp often fails to come on instantaneously with application of a high voltage between the electrodes 106A, 106B and conventional metal halide lamp must be ignited several times to come on. This is not very desirable if the metal halide lamp is to be used in vehicular headlights and other applications that must produce illumination instantaneously.

BRIEF SUMMARY OF THE INVENTION

The present invention has been accomplished under these circumstances and has as an object providing a metal halide lamp that is protected against fizzling out of an arc after it was switched on.

According to the present invention, the stated object is attained by appropriately adjusting the amount of the metal halide enclosed in the discharge space.

The present invention provides a metal halide lamp comprising a discharge vessel that forms a generally ellipsoidal discharge space extending longitudinally and a pair of electrodes embedded in said discharge vessel at the narrowest portions of said discharge space in such a way that their tips project into said discharge space, with mercury, a starter gas and a metal halide enclosed in said discharge space, characterized in that the amount of said metal halide being enclosed per unit volume of said discharge vessel is set within a range of 0.006–0.01 mg/$\mu$l.

The specific composition of the "starter gas" to be used in the invention is not limited. Xenon and argon gases are suitable starter gases.

The specific composition of the metal halide to be used in the invention also is not limited. Halides of metals such as thallium, sodium, indium and scandium, as well as mixtures thereof are suitable for use as the metal halides.

As noted above, the metal halide lamp of the present invention which has the metal halide enclosed in the generally ellipsoidal discharge space together with mercury and the starter gas is characterized in that the amount of the metal halide enclosed in unit volume of the discharge space is advantageously set in the range 0.006–0.01 mg/$\mu$l.

If the amount of metal halide enclosed in the discharge space does not exceed 0.01 mg/$\mu$l, its deposit on the inner surface of the discharge vessel in the lowest area midway between the right and left sides thereof will not come close enough to either electrode to cause "shunting". This prevents the fizzling out of an arc after the lamp was switched on. However, if the amount of metal halide enclosed in the discharge space is less than 0.006 mg/$\mu$l, the metal halide lamp can no longer produce the intended luminous flux and color of light.

Thus, the metal halide lamp of the invention which has the metal halide enclosed in the discharge space in an amount of 0.006–0.01 mg/$\mu$l produces the intended luminous flux and color of light, and yet successfully prevents the fizzling out of an arc after the lamp was switched on.

A word must be said about the above-defined range of the amount of the metal halide to be enclosed in the discharge space per unit volume. In certain circumstances, such as where the discharge space is an extremely oblong ellipsoid, the deposit of the metal halide on the inner surface of the discharge vessel in its lowest area midway between the right and left sides thereof can come unduly close to either electrode, even if the above-defined range is observed.

In the invention, the distance L from the tip position of each electrode to the position on the inner surface of the discharge vessel at its lowest area midway between the narrow end portions thereof, along with the input power P to the metal halide lamp, is adjusted such that the ratio L/P is set in the range 0.05–0.1 mm/W. This ensures that the deposit of the metal halide on the inner surface of the discharge vessel in its lowest area midway between the narrow end portions thereof will not come unduly close to either electrode.

If the ratio L/P is greater than 0.1 mm/W, the distance between each electrode and the position on the inner surface of the discharge vessel at its lowest portion midway between the narrow end portions thereof is very great. Thus, even when the lamp is on, the temperature in that position does not rise sufficiently to create adequate light emission. The lamp, in turn, fails to produce the desired luminous flux and light of color. Since the input power P is generally proportional to the capacity of the discharge space, the ratio L/P has the advantage of using a straightforward index keyed to the size of the discharge vessel to determine input power.

BRIEF DESCRIPTION OF THE DRAWINGS

FIG. 3(*a*) shows how an arc grows in the metal halide lamp of the invention after it was switched on;

FIG. 3(*b*) shows how an arc grows in a comparative metal halide lamp after it was switched on;

DETAILED DESCRIPTION OF THE INVENTION

An embodiment of the present invention is described below with reference to accompanying drawings.

Figure 1:
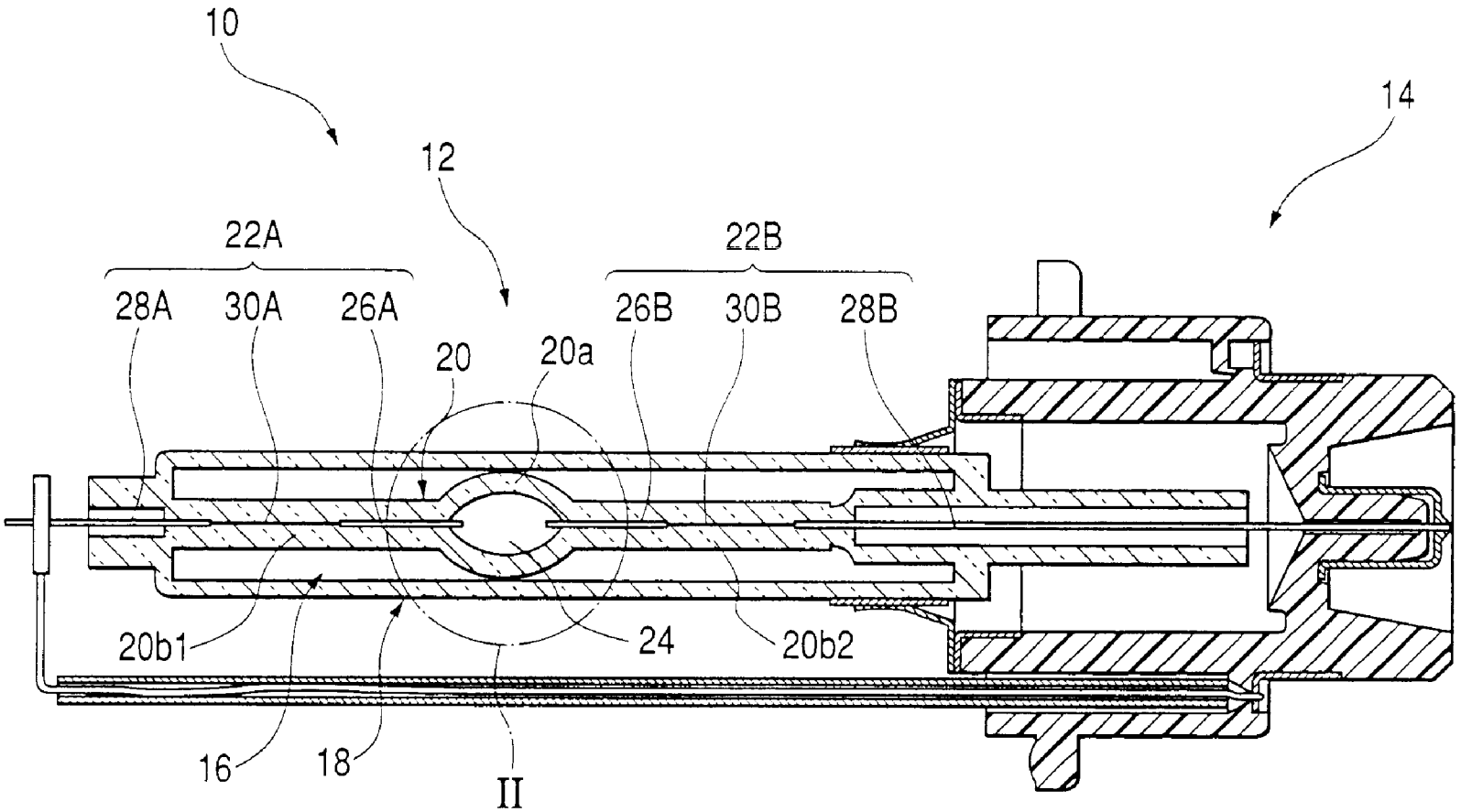
FIG. 1 is a longitudinal section of a discharge bulb incorporating a metal halide lamp according to an embodiment of the invention.
Figure 2:
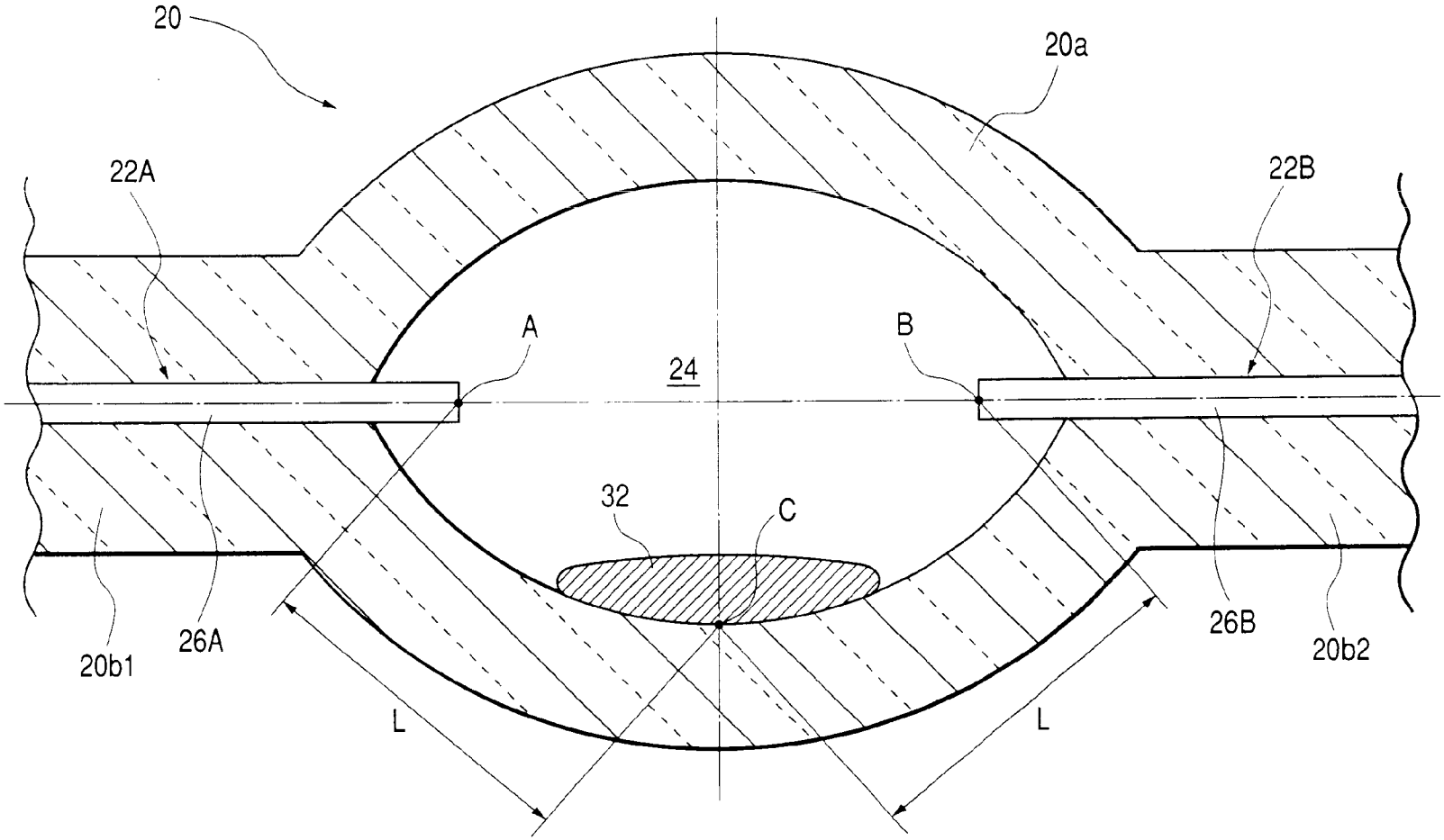
FIG. 2 is an enlarged view of the area indicated by II in FIG. 1.

FIG. 1 is a longitudinal section of a discharge bulb 10 incorporating a metal halide lamp according to an embodiment of the invention. FIG. 2 is an enlarged view of the area indicated by II in FIG. 1.

The discharge bulb 10 is a light source bulb to be mounted in a vehicular headlight and, as FIG. 1 shows, it comprises an arc tube unit 12 extending in a longitudinal direction and an insulated plug unit 14 supporting the rear end portion of the arc tube unit 12 in position.

The arc tube unit 12 is an integral combination of an arc tube 16 composed of the metal halide lamp and a shroud tube 18 that surrounds the arc tube 16.

The arc tube 16 consists of a body 20 worked from a quartz glass tube into a slender cylindrical form and a pair of electrode assemblies 22A, 22B embedded in the body 20 along its longitudinal axis. Preferably, the input power to the arc tube 16 is set at 35 W.

The arc tube body 20 has a generally ellipsoidal discharge vessel 20*a* formed in the center and pinch seal portions 20*b*1 and 20*b*2 formed on either side of the discharge vessel 20*a*, respectively. A generally ellipsoidal discharge space 24 is formed within the discharge vessel 20*a* in such a way that it extends longitudinally within the discharge vessel 20*a*.

The electrode assembly 22A (or 22B) consists of a rod electrode 26A (or 26B) and a lead wire 28A (or 28B) that are connected in position by means of molybdenum foil 30A (or 30B) and it is pinch sealed in the pinch seal portion 20*b*1 (or 20*b*2) of the arc tube body 20. The molybdenum foils 30A, 30B are entirely embedded in the pinch seal portions 20*b*1, 20*b*2, but the tip portions of the electrodes 26A, 26B project into the discharge space 24 from opposite sides to face each other.

The discharge space 24 has a capacity of about 20–50 $\mu$l. Enclosed in the discharge space 24 are mercury for sustaining a discharge between the tips of the electrodes 26A, 26B, a starter gas for assisting in the generation of a discharge, and a metal halide for enhanced lamp efficiency and color rendering.

The amount of the mercury enclosed in the discharge space is in the range 0.5–1.0 mg. Inert xenon gas is used as the starter gas at a pressure of about 4–8 atm. The metal halide consists of sodium iodide and scandium iodide that are mixed in a weight ratio from about 4:1 to about 7:3. The amount of the metal halide being enclosed in the discharge space is set in the range 0.18–0.3 mg (0.006–0.01 mg/$\mu$l when calculated for the amount enclosed per unit volume).

The metal halide is enclosed as pellets in the discharge space 24. When the lamp comes on, the pellets evaporate. If the lamp is subsequently turned out, the temperature in the discharge space 24 drops and the metal halide becomes fluid and deposits on the inner surface of the discharge vessel 20*a* in its lowest position midway between the narrow end portions of the vessel, as indicated by the metal halide deposit 32 in FIG. 2 (this is also the coldest position of the discharge space 24).

Referring to FIG. 2, the lowest position C of the inner surface of the discharge vessel 20*a* which is midway between the narrow end portions thereof. It is also spaced from the tip position A (or B) of the electrode 26A (or 26B) by distance L which is in the range of 1.75–3.5 mm (0.05–0.1 mm/W in terms of the ratio L/P, recalling that P is the input power to the arc tube 16).

The mechanism of action of the metal halide lamp according to the embodiment under consideration will now be described.

Figure 3B:
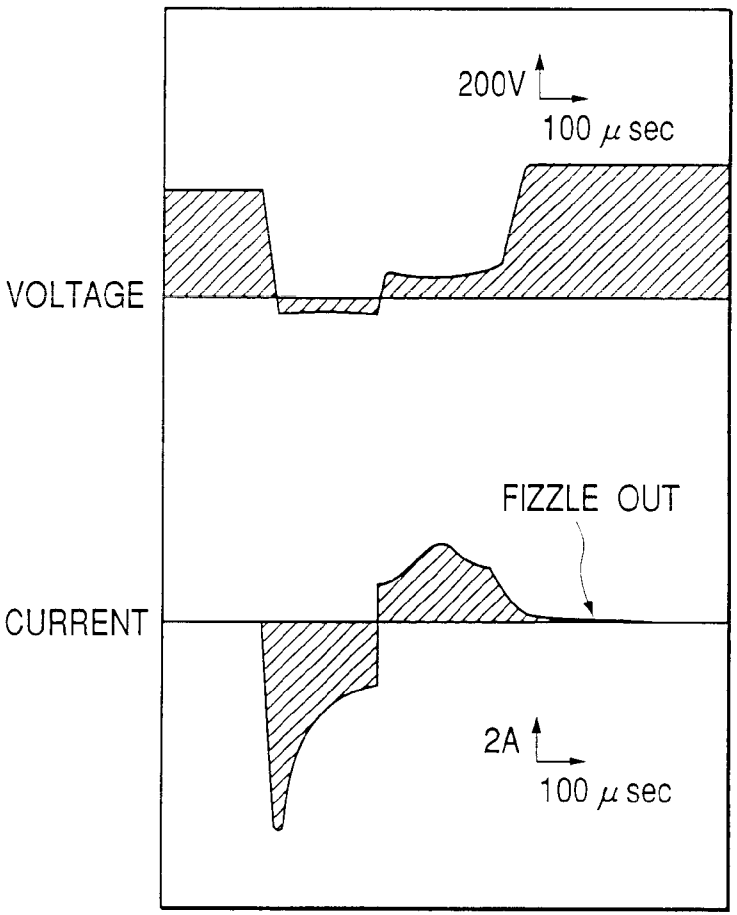
Figure 3A:
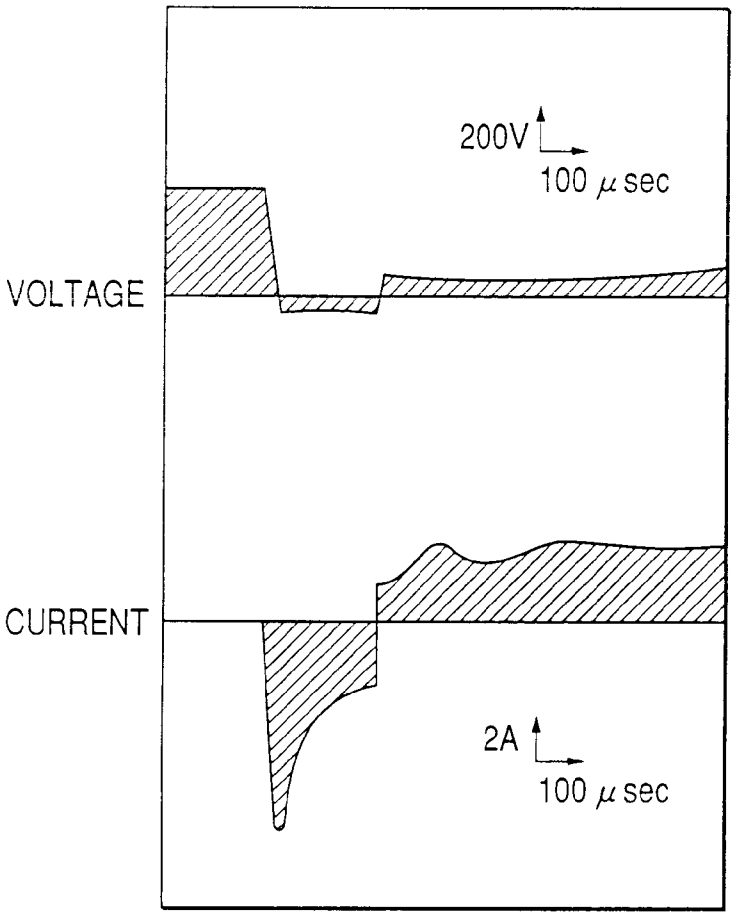

FIG. 3(*a*) shows how an arc grows in the metal halide lamp of the embodiment after it was switched on. FIG. 3(*b*) shows how an arc grows in a comparative metal halide lamp after it was switched on. In the metal halide lamp used for comparison, the amount of the metal halide enclosed in the discharge space 24 was in excess of 0.01 mg/$\mu$l.

Referring to FIG. 3(*a*), when a high voltage is applied between the two electrodes 26A, 26B, a large negative current flows temporarily, but a positive current soon flows between the two electrodes 26A, 26B. Subsequently, a predetermined current flows in a stable manner. As a result, the arc developing between the electrodes 26A, 26B reaches a steady state.

Referring to FIG. 3(*b*), if an excessive amount of the metal halide is enclosed in the discharge space 24, a large negative current flows temporarily, and then a positive current flow occurs. However, the arc does not reach a steady state, but instead fizzles out in the absence of any current flow.

Figure 4:
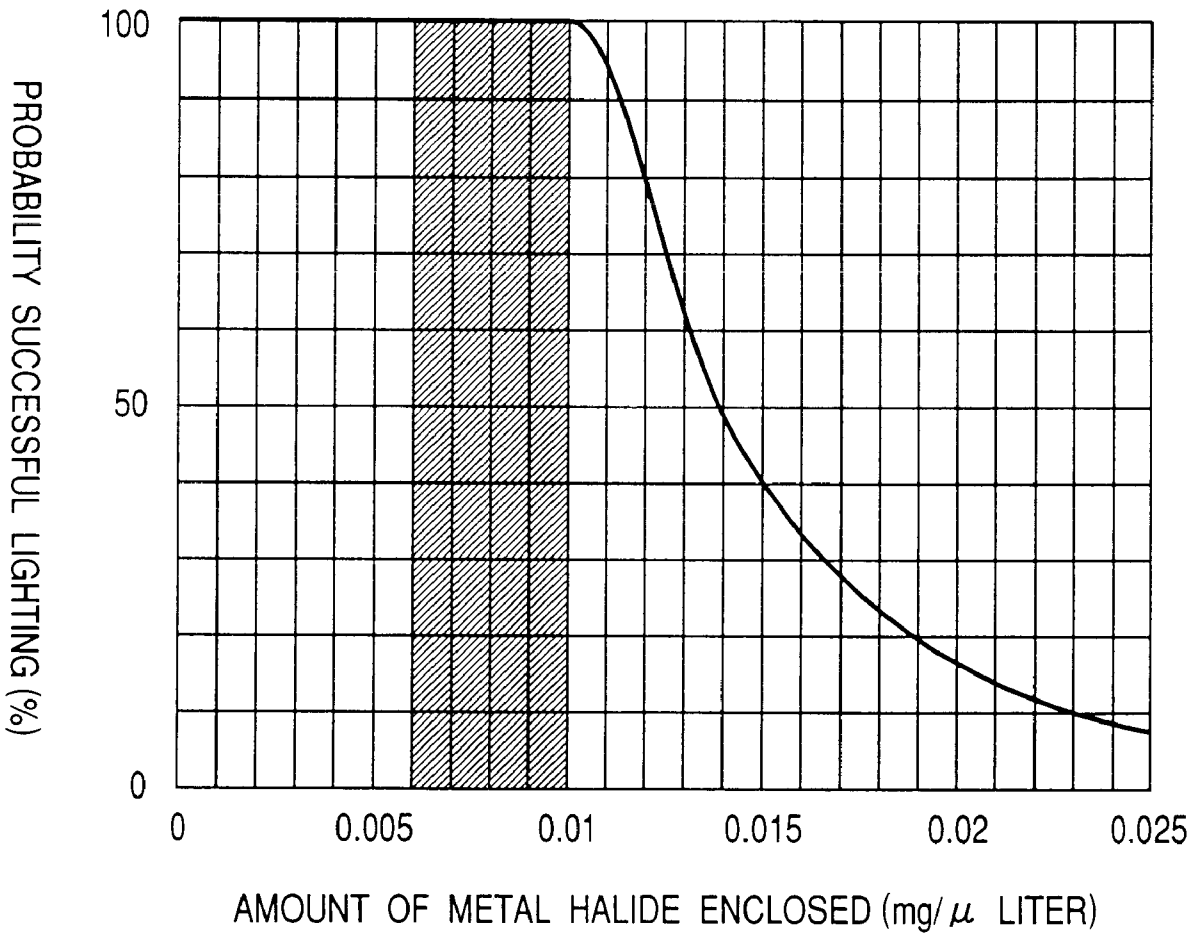
FIG. 4 is a graph showing the observed relationship between the amount of the metal halide enclosed in the discharge space per unit volume and the probability of successful lighting of the metal halide lamp.
Figure 5:
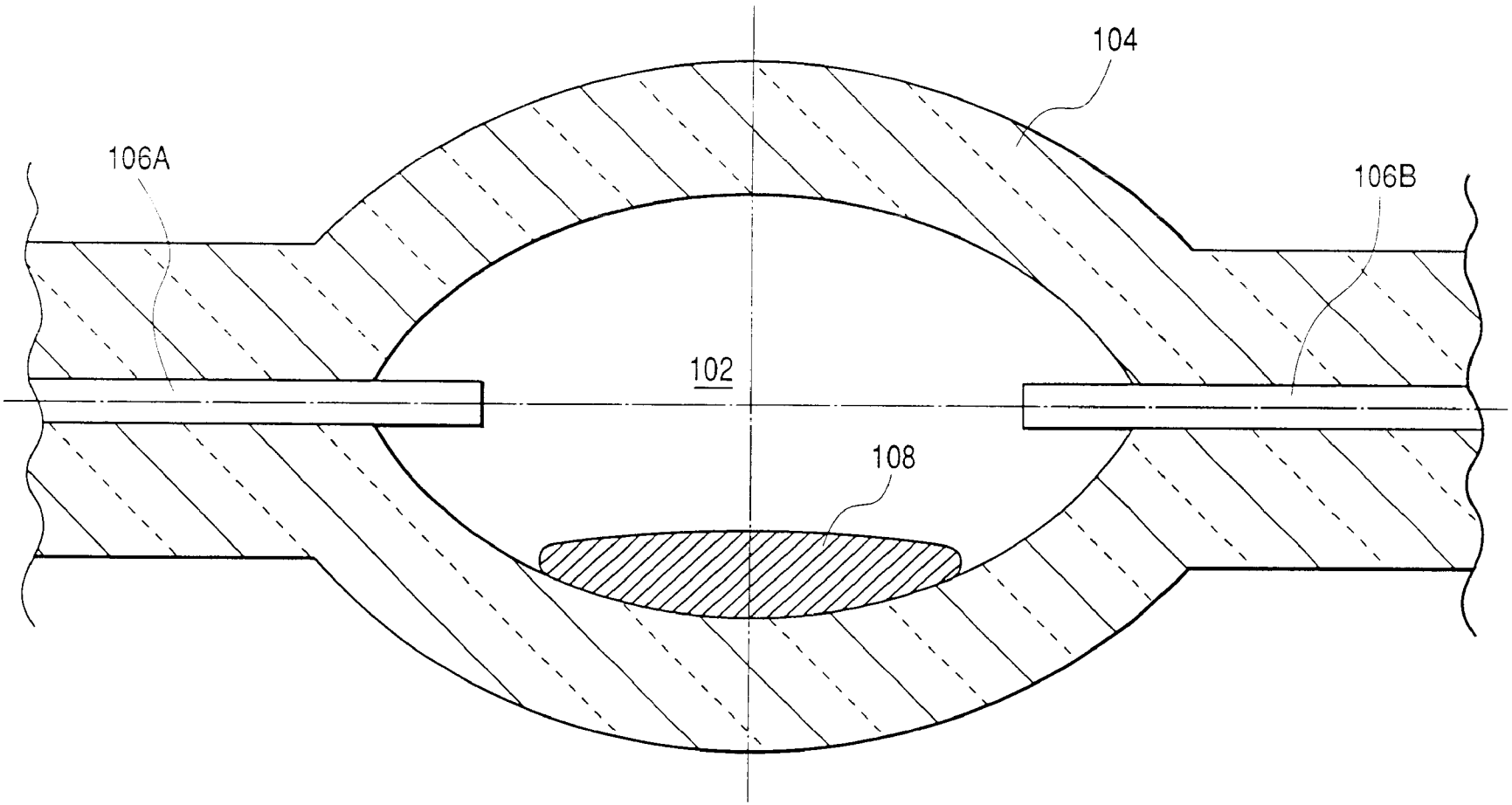
FIG. 5 Prior Art
FIG. 5 shows a prior art metal halide lamp.

FIG. 4 is a graph showing the observed relationship between the amount of the metal halide enclosed in the discharge space 24 per unit volume and the probability of successful lighting of the metal halide lamp.

Obviously, the probability of successful lighting was 100% when the amount of the metal halide enclosed in the discharge space 24 per unit volume was no more than 0.01 mg/$\mu$l. However, the probability of success dropped sharply when this value was exceeded.

Referring to FIG. 2, if the amount of the metal halide enclosed in the discharge space 24 per unit volume exceeds 0.01 mg/$\mu$l, the metal halide deposit 32 on the inner surface of the discharge vessel 20*a* in its lowest area midway between the narrow end portions of the vessel becomes very close to the electrodes 26A, 26B. As a result, a portion of the growing arc moves toward the metal halide 32 and the effective impedance between the electrodes decreases to an unduly low level.

Therefore, the amount of the metal halide being enclosed in the discharge space per unit volume is preferably set at 0.01 mg/$\mu$l or below in order to ensure successful lighting.

It should, however, be noted that if the discharge space 24 contains less than 0.006 mg/μl of the metal halide, the metal halide lamp can no longer produce the intended luminous flux or color of light.

The metal halide lamp wherein the metal halide enclosed in unit volume of the discharge space 24 in an amount of 0.006–0.01 mg/μl prevents the fizzling out of an arc after the lamp was switched on. A metal halide lamp according to the embodiment under consideration is highly suitable for use on vehicular headlights that must come on as soon as they are energized with input power.

Referring to FIG. 2, in the metal halide lamp according to the embodiment under consideration, the lowest position C of the inner surface of the discharge vessel 20*a* which is located midway between its right and left sides is spaced from the tip position A (or B) of the electrode 26A (or 26B) by distance L. This distance is set at a value not smaller than 1.75 mm. Therefore, if the amount of the metal halide being enclosed in the discharge space 24 is set within the stated range, one can positively ensure that the deposit of the metal halide 32 on the inner surface of the discharge vessel 20*a* in its lowest area midway between the right and left sides of the vessel will not come unduly close to either electrode 26A, 26B.

The upper limit of the distance L is 3.5 mm. If the distance L exceeds this value, the temperature in the lowest position of the inner surface of the discharge vessel 20*a* does not rise sufficiently to give adequate light emission, thereby causing a failure to produce the desired luminous flux and light of color. The upper limit of 3.5 mm for the distance L effectively prevents the occurrence of this problem.

Preferably, the metal halide lamp according to the preferred embodiment receives an input power of 35 W, with the discharge space 24 having a capacity of about 30 μl. The same advantages as described above can be obtained with metal halide lamps of other specifications if the amount of the metal halide being enclosed in the discharge space 24 per unit volume is set within the range 0.006–0.01 mg/μl and if the distance L from the lowest position C of the inner surface of the discharge vessel 20*a* to the tip position A (or B) of the electrode 26A (or 26B) and the input power P to the arc tube 16 are adjusted such that the ratio L/P is set to lie within the range 0.05–0.1 mm/W.

The amount of the metal halide enclosed in the discharge space 24 per unit volume is more preferably set within the range 0.007–0.009 mg/μl. The ratio of the distance L to the input power P (L/P) is more preferably set within the range 0.06–0.09 mm/W.

The metal halide lamp according to the preferred embodiment is also assumed to constitute the arc tube 16 in the discharge bulb 10 that is to be mounted on a vehicular headlight. Needless to say, the metal halide lamp may be used in other applications.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated.

What is claimed is:

1. A metal halide lamp, comprising:

a discharge vessel containing a generally ellipsoidal discharge space;

a pair of electrodes embedded in said discharge vessel, a tip of each of said electrodes projecting into said discharge space; and said discharge space enclosing at least mercury, a starter gas and a metal halide, wherein the amount of said metal halide enclosed per unit volume of said discharge space is within a predetermined range thereby preventing said metal halide lamp from fizzling out, and wherein the ratio of L to P is within a range of 0.05–0.1 mm/W, wherein L is the distance from the tip of each of said electrodes to a position on an inner surface of said discharge vessel which is at its lowest area midway between narrow end potions of said discharge vessel and P is an input power to said metal halide lamp, said distance L being shorter than a distance between said pair of electrodes.

2. The metal halide lamp according to claim 1, wherein the amount of said metal halide enclosed per unit volume of said discharge space is not more than 0.01 mg/μl.

3. The metal halide lamp according to claim 1, wherein the amount of said metal halide enclosed per unit volume of said discharge space is within a range of 0.006–0.01 mg/μl.

4. The metal halide lamp according to claim 1, wherein the amount of said metal halide enclosed per unit volume of said discharge space is within a range of 0.007–0.009 mg/μl.

5. The metal halide lamp according to claim 1, wherein the amount of said mercury enclosed in said discharge space is within a range of 0.5–1.0 mg.

6. The metal halide lamp according to claim 1, wherein the volume of said discharge space is at least 20 μl.

7. The metal halide lamp according to claim 1, wherein the volume of said discharge space is not more than 50 μl.

8. The metal halide lamp according to claim 1, wherein the input power to said metal halide lamp is 35 W.

9. The metal halide lamp according to claim 1, wherein said metal halide comprises sodium iodide and scandium iodide.

10. The metal halide lamp according to claim 8, wherein said sodium iodide and said scandium iodide are mixed in a weight ratio from 4:1 to 7:3.

* * * * *